US005701760A

United States Patent [19]

Torigoe et al.

[11] Patent Number: 5,701,760

[45] Date of Patent: Dec. 30, 1997

[54] REFRIGERANT EVAPORATOR, IMPROVED FOR UNIFORM TEMPERATURE OF AIR BLOWN OUT THEREFROM

[75] Inventors: Eiichi Torigoe; Masahiro Shimoya, both of Kariya, Japan

[73] Assignee: Denso Corporation, Kariya, Japan

[21] Appl. No.: 730,990

[22] Filed: Oct. 16, 1996

[30] Foreign Application Priority Data

Oct. 20, 1995 [JP] Japan ..... 7-273221
Jul. 11, 1996 [JP] Japan ..... 8-182307

[51] Int. Cl.[6] ..... F25B 39/02

[52] U.S. Cl. ..... 62/524; 165/153; 165/DIG. 465

[58] Field of Search ..... 62/524, 526; 165/153, 165/176, DIG. 465, DIG. 466

[56] References Cited

U.S. PATENT DOCUMENTS 4,589,265 5/1986 Nozawa ..... 62/526
5,024,269 6/1991 Noguchi et al. ..... 165/153
5,205,347 4/1993 Hughes ..... 62/526

FOREIGN PATENT DOCUMENTS

U712778 3/1995 Japan .

*Primary Examiner*—William E. Tapolcai
*Attorney, Agent, or Firm*—Harness, Dickey & Pierce, PLC

[57] ABSTRACT

According to the present invention, plural downstream side evaporation passages in a downstream side heat exchanging unit are divided into two groups substantially at the middle of the width by a separator, plural upstream side evaporation passages in an upstream side heat exchanging unit are divided into two groups substantially at the middle of the width by a separator, and a downstream side lower tank and an upstream side upper tank are communicated by a communication passage so that inefficient heat exchanging areas of the downstream side heat exchanging unit and the upstream side heat exchanging unit disposed one after the other with respect to the flowing direction of air may not overlap with each other. Since the inefficient heat exchanging area in the downstream side heat exchanging unit and the inefficient area in the upstream side heat exchanging unit are disposed symmetrically with each other, the temperature distribution of air blown out from the refrigerant evaporator is prevented from being biased, and air having a uniform temperature distribution can be produced by the refrigerant evaporator.

11 Claims, 11 Drawing Sheets

REFRIGERANT EVAPORATOR, IMPROVED FOR UNIFORM TEMPERATURE OF AIR BLOWN OUT THEREFROM

CROSS REFERENCE TO THE RELATED APPLICATION

This application is based on and claims priority of Japanese Patent Application Nos. Hei. 7-273221 filed on Oct. 20, 1995, and Hei. 8-182307 filed on Jul. 11, 1996, the contents of which are incorporated herein by reference.

BACKGROUND OF THE INVENTION

1. Field of the Invention

The present invention relates to a refrigerant evaporator which evaporates and gasifies the refrigerant by performing heat exchange between a gas-liquid two-phase refrigerant received from a pressure reducing means and air.

2. Description of Related Art

Recently, there have been high demands for downsizing a refrigerant evaporator, i.e., one of the components for forming the refrigeration cycle for an automotive air conditioner, by reducing the depth, i.e., a dimension in the flowing direction of air in a unit case, for increasing the size of the refrigerant evaporator by increasing the width and the height, i.e., dimensions in directions perpendicular to the airflow direction in the unit case, and for leveling the distribution of the temperature of air blown out from the refrigerant evaporator. There is also a demand for extending a refrigerant inlet and a refrigerant outlet in the same direction from one side surface of the refrigerant evaporator in view of the relation of the installation of the other components for forming the refrigeration cycle with the refrigerant evaporator.

Referring to FIG. 10, a refrigerant evaporator 100 proposed in JP-U-7-12778 has a downstream side heat exchanging unit 104 constructed by laminating in the direction of width plural refrigerant passage units each having an upper tank 101, a refrigerant evaporation passage 102 and a lower tank 103, and an upstream side heat exchanging unit 108 constructed by laminating plural refrigerant passage units each having an upper tank 105, refrigerant evaporation passages 106 and a lower tank 107. The downstream side heat exchanging unit 104 and the upstream side heat exchanging unit 108 are disposed one after the other in the airflow direction, and a refrigerant inlet 109 and a refrigerant outlet 110 are extended in the same direction from one side of the refrigerant evaporator 100.

In this refrigerant evaporator 100, the right end of the upper tank 101 and the right end of the upper tank 105 are communicated by a communication passage 111, the refrigerant inlet is formed in the left end of the upper tank 101, and the refrigerant outlet is formed in the left end of the upper tank 105. The upper tanks 101 and 105 are provided substantially in middle portions with partition members 112 and 113 for dividing the refrigerant evaporation passages 102 and 106 into two sections, respectively, so that the refrigerant flows through the two sections of each of the refrigerant evaporation passages as shown in FIG. 10.

The refrigerant having flowed from the refrigerant inlet 109 into the left section of the upper tank 101 flows through the left section of the refrigerant evaporation passage 102, the lower tank 103, the right section of the refrigerant evaporation passage 102, the right section of the upper tank 101, the communication passage 111, the right section of the upper tank 105 of the upstream side heat exchanging unit 108, the right section of the refrigerant evaporation passage 106, the lower tank 107, the left section of the refrigerant evaporation passage 109 and the left section of the upper tank 105 in that order and flows outside through the refrigerant outlet 110.

In this refrigerant evaporator 100, the refrigerant flowing in one direction through the upper tanks 101 and 105 is distributed to the refrigerant evaporation passages 102 and 106. Therefore, most part of the refrigerant may flow by gravity more easily into portions of the refrigerant evaporation passages connected to portions of the upper tanks 101 and 105 on the upstream side than portions on the downstream side. Since the refrigerant flows upward from the lower tanks 103 and 107 into the refrigerant evaporation passages 102 and 106 after the refrigerant has reached portions of the lower tanks 103 and 107 on the downstream side, the refrigerant may flow easily into portions of the refrigerant evaporation passages 102 and 106 connected to the downstream side of the lower tanks 103 and 107.

When the refrigerant thus flows in the refrigerant evaporator 100 shown in FIG. 10, the direction of flow of the refrigerant in the refrigerant evaporation passage 102 of the downstream side heat exchanger 104 and that of flow of the refrigerant in the refrigerant evaporation passage 106 of the upstream side heat exchanger 108 facing the refrigerant evaporation passage 102 are opposite to each other. Consequently, the distribution of flow the refrigerant in the upstream side heat exchanger 108 and that of flow of the refrigerant in the downstream side heat exchanger 104 coincide substantially with each other and hence there is a problem that the distribution of the temperature of air blown out from the refrigerant evaporator may be biased.

SUMMARY OF THE INVENTION

Accordingly, it is an object of the present invention to suppress the biased distribution of the temperature of air blown out from the refrigerant evaporator due to the uneven flow of the refrigerant into the refrigerant evaporation passages.

According to the present invention, in a refrigerant evaporator having plural first evaporation passages through which the refrigerant flows, a first tank portion connected to each of upper ends and lower ends of the plural first evaporation passages, plural second evaporation passages through which the refrigerant flows, a second tank portion connected to each of upper ends and lower ends of the plural second evaporation passages, and the second tank portion being extended in a direction crossing the second evaporation passages, and a communication passage for communicating between the plural first evaporation passages and the plural second evaporation passage, the refrigerant flows in the same vertical direction at least in portions where the plural first evaporation passages and the plural second evaporation passages overlap with each other with respect to the flowing direction of the outside air, and the flowing direction of the refrigerant in the first tank portion connected to the first evaporation passages and that in the second tank portion connected to the second evaporation passages are opposite to each other. Therefore, when the refrigerant evaporator is viewed in the flowing direction of the outside air, the bias of the refrigerant flowing in the first evaporation passages and that of the refrigerant in the second evaporation passages are complemented each other.

That is, the evaporation passage groups of the first evaporation passages where the liquid refrigerant is easy to flow and the evaporation passage groups of the second evaporation passages where the liquid refrigerant is hard to flow are symmetrical with each other. Consequently, by not overlapping the first evaporation passages overlapping with the second evaporation passages with respect to the flowing direction of the outside air, in which air is not cooled efficiently, the bias of distribution of the temperature of air passed the outside of the first evaporation passages and the outside of the second evaporation passages can be suppressed.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

A first embodiment of the present invention will be described.

Figure 1:
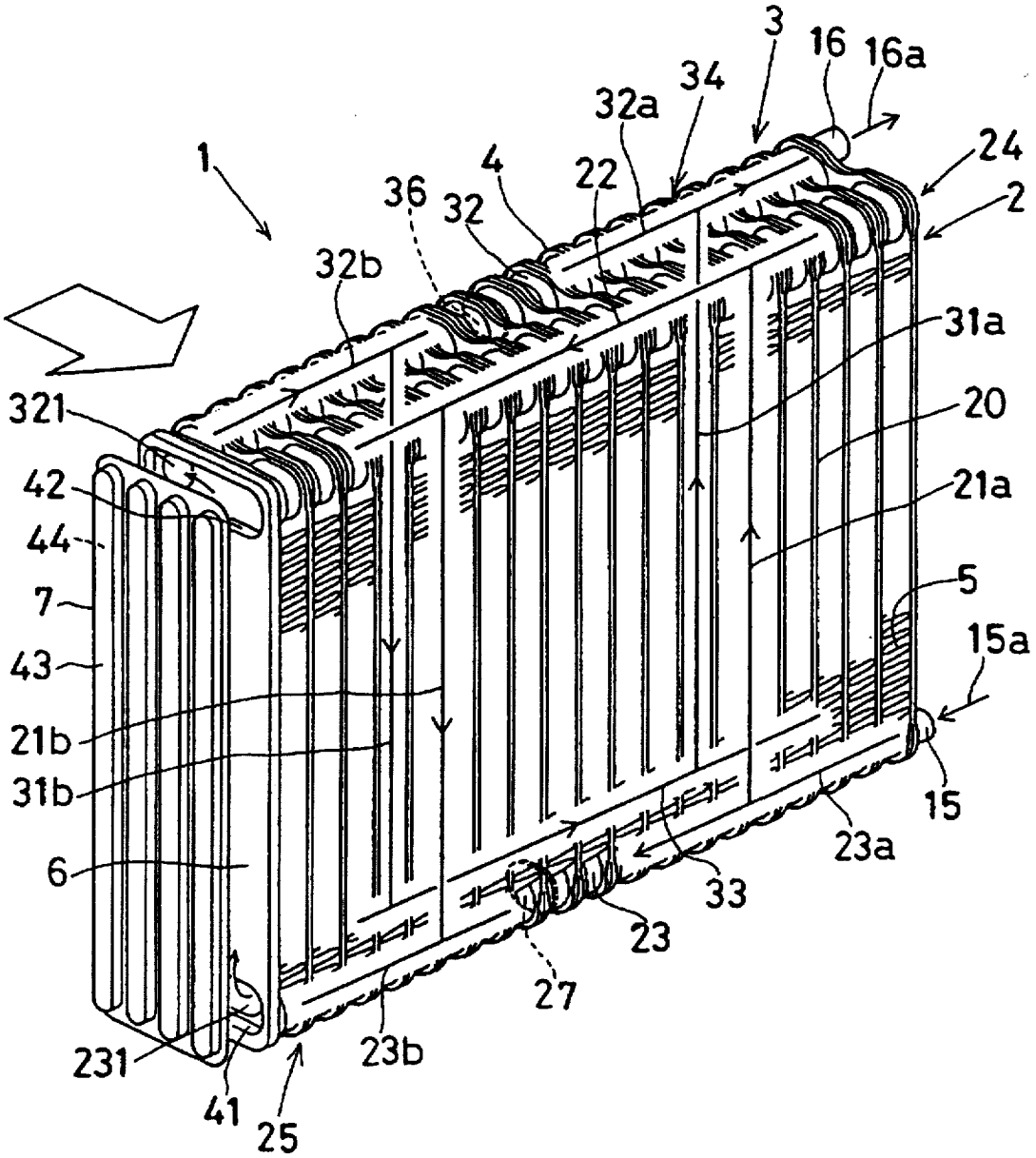
FIG. 1 is a perspective view of a left-right two-sectioned refrigerant evaporator in a first embodiment.
Figure 2:
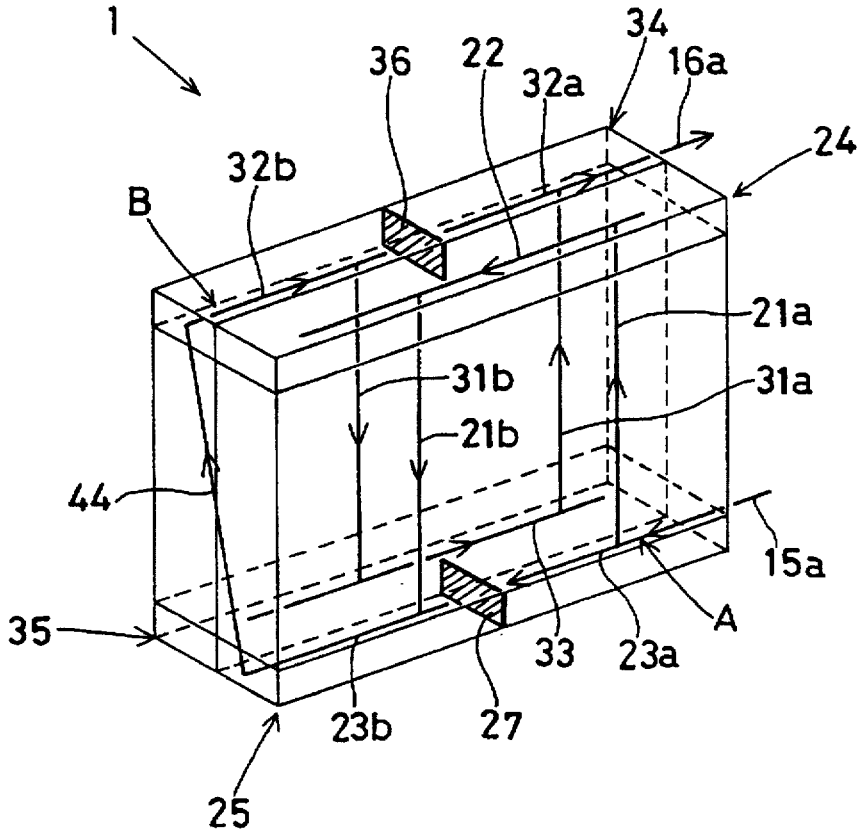
FIG. 2 is a diagrammatic view for explaining the flowing direction of a refrigerant in the refrigerant evaporator in the first embodiment.
Figure 3:
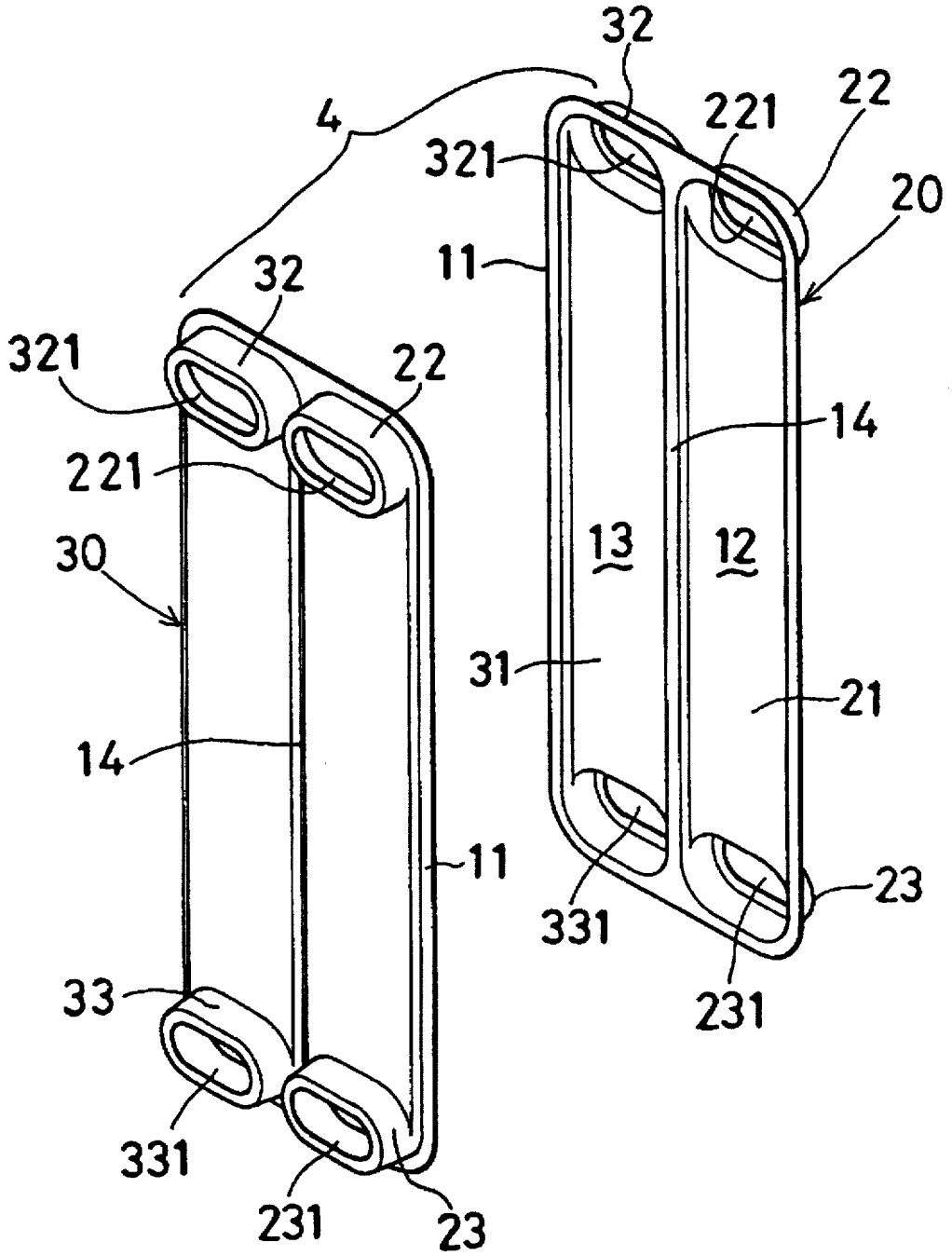
FIG. 3 is a perspective view of a pair of pressed plates employed in the first embodiment.

FIG. 1 is a perspective view of a left-right two-sectioned refrigerant evaporator in a first embodiment according to the present invention, FIG. 2 is a diagrammatic view showing the flow of a refrigerant in the refrigerant evaporator of FIG. 1, and FIG. 3 is a perspective view of a pair of plates.

The left-right two-sectioned refrigerant evaporator (hereinafter referred to simply as "refrigerant evaporator") 1 is a laminated heat exchanger functioning as an evaporator for forming the refrigeration cycle of an automotive air conditioner. The refrigerant evaporator 1 cools air by heat exchanging between the air passing therethrough and a refrigerant flowing therein so as to vaporize and gasify the refrigerant. The refrigerant evaporator 1 is installed perpendicularly to the airflow direction in an air duct (unit case) of air conditioner, for example, in a front section of the passenger compartment of a vehicle. The refrigerant evaporator 1 has a downstream side heat exchanging unit (a heat exchanger body, or an evaporator body) 2 on the downwind side (downstream side) with respect to the airflow direction, and a front heat exchanging unit (a heat exchanger or an evaporator) 3 disposed on the upwind side (upstream side, or front side) with respect to the flowing direction of air.

Each of the downstream side heat exchanging unit 2 and the upstream side heat exchanging unit 3 includes plural pairs of pressed plates 4 laminated in the width direction perpendicular to the airflow direction (horizontal direction), plural corrugated fin plates 5 disposed between the adjacent pressed plates for improving the efficiency of heat exchange (heat transfer efficiency) between the refrigerant and air, an end plate 6, and a side plate 7. The end plate 6 and the side plate 7 reinforce the downstream side heat exchanging unit 2 and the upstream side heat exchanging unit 3. Those components are integrally joined together by brazing in a furnace.

The pair of pressed plates 4 will be described in detail with reference to FIGS. 1 to 3. The pair of pressed plates 4 are formed by pressing thin aluminum alloy plates having a high thermal conductivity. The pair of pressed plates 4 are joined together by brazing. Each pressed plate 4 has a substantially rectangular flange 11, and a partition rib 14 for dividing a space surrounded by the flange 11 into two elongated (I-shaped) recesses 12 and 13.

The pair of pressed plates 4 define a downstream side passage tube 20 on the downstream air side with respect to the airflow direction, and an upstream side passage tube 30 on the upstream air side with respect to the airflow direction. The downstream side passage tube 20 has a second evaporation passage 21 formed by the elongated recesses 12 of the pair of pressed plates 4. The front passage tube 30 has a first evaporation passage 31 formed by the elongated recesses 13 of the pair of pressed plates 4.

The second evaporation passage 21 is formed on the upstream air side with respect to the flowing direction of the refrigerant relative to the first evaporation passage 31 to evaporate and gasify the refrigerant by performing the heat exchange between the liquid-dominant gas-liquid two-phase refrigerant flowing through the second evaporation passage 21 and air. The opposite surfaces of the pair of pressed plates 4 forming the second evaporation passage 21 may be provided with plural ribs to spread the refrigerant in a width direction of the passage and with inner fins to promote the heat transfer.

The first evaporation passage 31 is formed on the downstream side with respect to the flowing direction of the refrigerant relative to the second evaporation passage 21. The gas-dominant gas-liquid two-phase refrigerant flowing through the first evaporation passage 31 absorbs heat from air and evaporates. The opposite surfaces of the pair of pressed plates 4 forming the first evaporation passage 31 may be provided with plural ribs (protrusion) for spreading the refrigerant widthwise or inner fins for promoting heat transfer.

A second upper tank portion 22 is formed at the upper end of the downstream side passage tube 20, i.e., the upper side of the second evaporation passage 21, and a second lower tank portion 23 is formed at the lower end of the downstream side passage tube 20, i.e., the lower side of the second evaporation passage 21. A first upper tank portion 32 is formed at the upper end of the front passage tube 30, i.e., the upper side of the first evaporation passage 31, and a first lower tank portion 33 is formed at the lower end of the front passage tube 30, i.e., the lower side of the first evaporation passage 31.

Elliptic communication holes 221 and 231 are formed in the second upper tank portion 22 and the second lower tank portion 23, respectively. The interiors of the adjacent downstream side passages 20 communicate with each other by the holes 221 and 231. Elliptic holes 321 and 331 are formed in the first upper tank portion 32 and the first lower tank portion 33, respectively. The interiors of the adjacent upstream side passage tube 30 communicate with each other by the holes 321 and 331. Thus, the upper half and the lower half of the pair of pressed plates 4 are symmetric with respect to a horizontal center axis, and the upstream side half and the downstream side half of the pair of pressed plates 4 are symmetric with respect to a vertical center line. A second upper tank 24 is formed at the upper end of the downstream side heat exchanging unit 2 by communicating plural second upper tank portions 22 in the direction of laminating the downstream side passage tubes 20, as shown in FIG. 1. A second lower tank 25 is formed at the lower end of the downstream side heat exchanging unit 2 by communicating plural second lower tank portions 23 in the direction of laminating the downstream side passage tubes 20, as shown in FIG. 1.

A separator 27 is at the substantially middle of the second lower tank 25 with respect to the width direction (the laminating) to divide the plural second lower tank portions 23 into two lower tank groups **23*a* and 23*b* (FIG. 2). The separator 27 is formed by not providing the communication holes 231 of the second lower tank portions 23 of the two downstream side passage tubes 20 substantially at the middle of the second lower tank 25 by partition walls. The separator serves also as a downstream side evaporation passage dividing means for dividing the plural second evaporation passages 21 into two groups (an even number of groups), i.e., a first evaporation passage group 21*a* and a second evaporation passage group 21*b* (FIG. 2**).

As shown in FIGS. 1 and 2, a first upper tank 34 is formed at the upper end of the upstream side heat exchanging unit 3 by communicating the first upper tank portions 32 in the direction of laminating the upstream side passage tubes 30. As shown in FIG. 2, a second lower tank 35 is formed at the upstream side heat exchanging unit 3 by communicating the first lower tank portions 33 in the direction of laminating the upstream side passage tubes 30.

A separator 36 is formed substantially at the middle of the first upper tank 34 with respect to the laminating direction to divide the plural first upper tank portions 32 into two upper tank portion groups **32*a* and 32*b* as shown in FIG. 2. The separator 36 divides the first upper tank 34 into two sections at a position substantially corresponding to the second evaporation passage 21 of the downstream side heat exchanging unit 2. The separator 36 is formed by not providing the holes 321 of the first upper tank portions 32 of the two upstream side passage tubes 30 substantially at the middle by partition walls. The separator 36 serves also as an upstream side evaporation passage dividing means for dividing the plural first evaporation passages 31 into a first evaporation passage group 31*a* and a second evaporation passage group 31*b* (FIG. 2**).

The lower tank portion group **23*a* forms a refrigerant inlet portion of the refrigerant evaporator 1. An inlet pipe 15 is connected to the second lower tank portion 23 of the right end downstream side passage tube 20. The inlet pipe 15 has an inlet passage communicating the downstream side heat exchanging unit 2 of the refrigerant evaporator 1 with a pressure reducing device (not shown) such as an expansion valve, a capillary tube or an orifice, as shown in FIG. 2**.

The upper tank portion group **32*a* forms a refrigerant discharge portion of the refrigerant evaporator 1. A discharge pipe 16 is connected to the first upper tank portion 32 of the right end downstream side passage tube 30. The discharge pipe 16 has a discharge passage 16*a* communicating the upstream side heat exchanging unit 3 of the refrigerant evaporator 1 with the suction port of a refrigerant compressor (not shown). Thus, the inlet pipe 15 and the discharge pipe 16 extend from one side surface of the refrigerant evaporator 1**, for instance, on the side of the engine compartment.

The end plate 6 and the side plate 7 will be described in detail with reference to FIG. 1. The end plate 6 is formed by processing a metal plate, such as an aluminum alloy plate, and is joined to the left ends of the downstream side heat exchanging unit 2 and the upstream side heat exchanging unit 3. Elliptic communication holes 41 and 42 to be communicated with the communication hole 231 of the left end second lower tank portion 23 of the lower tank portion group **23*b* and the hole 321 of the left end first upper tank portion 32 of the upper tank portion group 32*b* are formed in a lower end portion and an upper end portion of the end plate 6**, respectively.

The side plate 7 is formed by pressing a metal plate, such as an aluminum alloy plate and is provided with plural ribs (four ribs in this embodiment) 43. When the side plate 7 is joined to the end plate 6, plural communication passages (four communication passages in this embodiment) 44 are formed between the inner surfaces of the ribs 43 and the outer surface of the end plate 6. The communication passages 44 communicate the lower tank portion group **23*b* of the second lower tank 25 with the upper tank portion group 32*b* of the first upper tank 34, and serve as one-way passages for leading the refrigerant flowing from the second lower tank 25 toward the first upper tank 34**.

A downstream side refrigerant passage A is formed in the downstream side heat exchanging unit 2 by the separator 27, and an upstream side refrigerant passage B is formed in the upstream side heat exchanging unit 3 by the separator 36.

As shown in FIG. 2, the refrigerant flowing through the inlet passage **15*a* of the inlet pipe 15 is introduced through the downstream side refrigerant passage A of the downstream side heat exchanging unit 2, i.e., through the lower tank portion group 23*a* among the plural downstream side lower tank portions 23, the first evaporation passage group 21*a* among the plural downstream side evaporation passages 21, the plural downstream side upper tank portions 22, the second evaporation passage group 21*b* among the plural downstream side evaporation passages 21, the lower tank portion group 23*b* among the plural downstream side lower tank portions 23, and the communication passages 44** in this order.

The refrigerant flowing into the communication passages 44 is introduced through the upstream side refrigerant passage B, i.e., flows through the upper tank portion group **32*b* among the plural upstream side upper tank portions 32, the second evaporation passage group 31*b* among the plural upstream side evaporation passages 31, the plural upstream side lower tank portions 33, the first evaporation passage group 31***a* among the plural upstream side evaporation passages 31, the upper tank portion group 32*a* among the plural upstream side upper tank portions 32, and the discharge passage 16*a* of the discharge pipe 16 in this order.

An operation of the refrigerant evaporator in this embodiment will briefly be described with reference to FIGS. 1 to 5.

The low-temperature, low-pressure gas-liquid two-phase refrigerant which has been adiabatically expanded in the pressure reducing device flows through the inlet passage 15*a* of the inlet pipe 15 into the lower tank portion group 23*a* among the plural downstream side lower tank portions 23. Then, the refrigerant is distributed to the downstream side evaporation passages 21 of the first evaporation passage group 21*a* among the plural downstream side evaporation passages 21.

Figure 4:
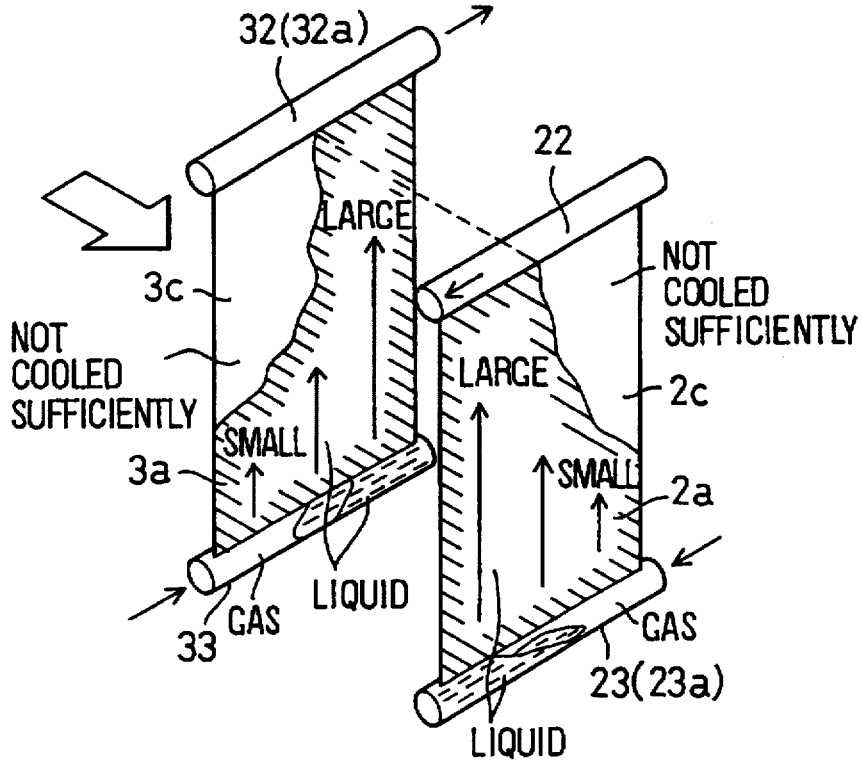
FIG. 4 is a diagrammatic view showing the state of the refrigerant in right evaporation passage groups of a first and a second heat exchanging unit in the first embodiment.

As shown in FIG. 4, the liquid-phase refrigerant among the gas-liquid two-phase refrigerant flowing through the lower tank portion group 23*a* flows into a downstream section (a rear side) of the lower tank portion group 23*a* by inertia, and the gas-phase refrigerant flows into an upstream section (a front side) of the lower tank portion group 23*a*. Consequently, the liquid-phase refrigerant is easy to flow into the downstream side lower evaporation passages 21 in a downstream section of the first evaporation passage group 21*a*, and the gas-phase refrigerant is easy to flow into the downstream side lower evaporation passages 21*a* in an upstream section of the first evaporation passage group 21*a*.

Accordingly, the efficiency of heat transfer from air flowing outside the plural downstream side passage tubes 20 to the refrigerant flowing through the downstream side evaporation passages 21 in the downstream section of the first evaporation passage group 21*a* is higher than that of heat transfer from air flowing outside the plural downstream side passage tubes 20 to the refrigerant flowing through the downstream side evaporation passages 21 in the upstream section of the first evaporation passage group 21*a*.

Consequently, air flowing outside the downstream side evaporation passages 21 in the downstream section of the first evaporation passage group 21*a* is cooled more efficiently than air flowing outside the downstream side evaporation passages 21 in the upstream section of the first evaporation passage group 21*a*. Air flowing outside the downstream side evaporation passages 21 in the upstream section of the first evaporation passage group 21*a* is not cooled efficiently.

Thus, the refrigerant flowing through the first evaporation passage group 21*a* is evaporated and gasified by the heat exchange with air, and the liquid-phase dominant gas-liquid two-phase refrigerant flows into the plural downstream side upper tank portions 22, and then flows through the downstream side upper tank portions 22 in the left half section into the downstream side evaporation passages 21 of the second evaporation passage group 21*b* among the plural downstream side evaporation passages 21.

Figure 5:
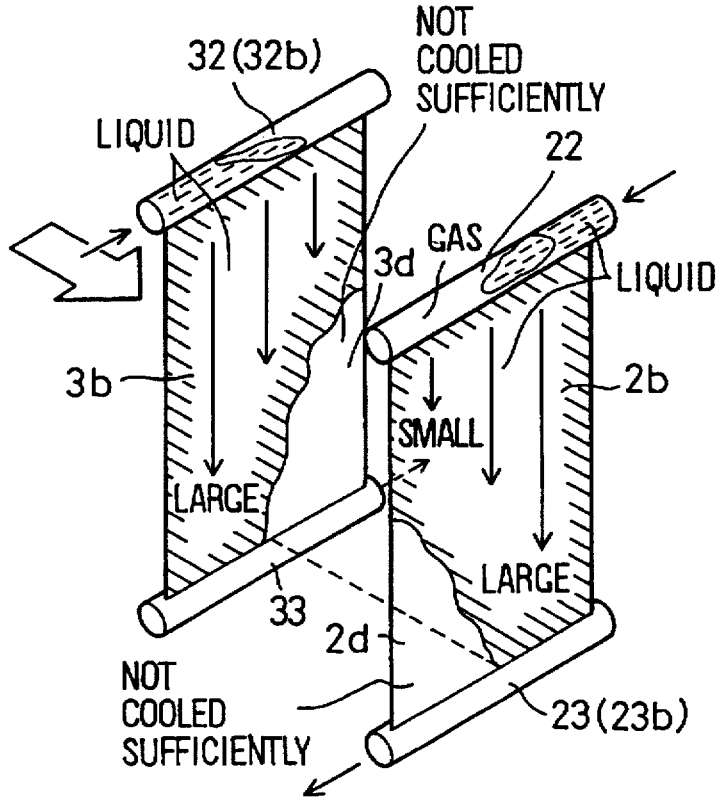
FIG. 5 is a diagrammatic view showing the state of the refrigerant in the left evaporation passage groups of the first and the second heat exchanging unit in the first embodiment.

As shown in FIG. 5, the liquid-phase refrigerant among the refrigerant flowing through the downstream side upper tank portions 22 in the left half section mainly flows into an upstream section by its gravity, and the gas-phase refrigerant mainly flows into a downstream section. Consequently, the liquid-phase refrigerant is easy to flow into the downstream side evaporation passages 21 in an upstream section of the second evaporation passage group 21*b* among those of the second evaporation passage group 21*b*, and the gas-phase refrigerant is easy to flow into the downstream side evaporation passages 21 in a downstream section of the second evaporation passage group 21*b* among those of the second evaporation passage group 21*b*.

Accordingly, the heat exchange efficiency between air flowing outside the plural downstream side passage tubes 20 and the refrigerant flowing through the downstream side evaporation passages 21 in the upstream section of the second evaporation passage group 21*b* is higher than that between air flowing outside the plural downstream side passage tubes 20 and the refrigerant flowing through the downstream side evaporation passages 21 in the downstream section of the first evaporation passage group 21*b*.

Consequently, air flowing outside the downstream side evaporation passages 21 in the upstream section of the second evaporation passage group 21*b* is cooled more efficiently than air flowing outside the downstream side evaporation passages 21 in the downstream section of the second evaporation passage group 21*b*. Air flowing outside the downstream side evaporation passages 21 in the downstream section of the second evaporation passage group 21*b* is not cooled efficiently.

Thus, the refrigerant flowing through the second evaporation passage group 21*b* is evaporated and gasified by the heat exchange with air to be the gas-liquid two-phase refrigerant having the liquid-phase dominant to some extent, and after flowing into the downstream side upper tank portions 22 of the upper tank portion group 22*b*, flows through the communication passages 45 into the upper tank portion group 32*b* of the upstream side heat exchanging unit 3. The refrigerant entered the upper tank portion group 32*b* is distributed to the upstream side evaporation passages 31 of the second evaporation passage group 31*b*.

As shown in FIG. 5, similarly to the flow of the refrigerant in the downstream side upper tank portions 22 in the left half section, the liquid-phase refrigerant mainly flows into an upstream section of the upper tank portion group 32*b* and the gas-phase refrigerant mainly flows into a downstream section of the upper tank portion group 22*b*. Consequently, the liquid-phase refrigerant is easy to flow into the upstream side evaporation passages 31 in an upstream section of the second evaporation passage group 31*b* and the gas-phase refrigerant is easy to flow into the upstream side evaporation passages 31 in a downstream section of the second evaporation passage group 31*b*.

Accordingly, the heat exchange efficiency between the air flowing outside the plural rear passage tubes 20 and the refrigerant flowing through the front evaporation passages 31 in the upstream section of the second evaporation passage group 31*b* is higher than that between the air and the refrigerant flowing through the front evaporation passages 31 in the downstream section of the second evaporation passage group 31*b*.

Consequently, air flowing outside the upstream side evaporation passages 31 in the upstream section of the second evaporation passage group 31*b* is cooled more efficiently than air flowing outside the upstream side evaporation passages 31 in the downstream section of the second evaporation passage group 31*b*. Air flowing outside the upstream side evaporation passages 31 in the downstream section of the second evaporation passage group 31*b* is not cooled efficiently.

Thus, the refrigerant flowing through the second evaporation passage group 31*b* is evaporated and gasified by heat exchange with air to be the gas-phase dominant gas-liquid two-phase refrigerant and flows into the upstream side lower tank sections 33. Then, the refrigerant entered the upstream side lower tank portions 33 in the right half section is distributed to the upstream side evaporation passages 31 of the first evaporation passage group 31*a*.

As shown in FIG. 4, similarly to the refrigerant in the lower tank portion group 23*a*, the liquid-phase refrigerant among the gas-liquid two-phase refrigerant mainly flows into the lower tank portions 33 in a downstream section, and the gas-phase refrigerant mainly flows in the lower tank portions 33 in an upstream section. Therefore, the liquid-phase refrigerant is easy to flow into the upstream side evaporation passages 31 in the downstream section of the first evaporation passage group 31*a*, and the gas-phase refrigerant is easy to flow into the upstream side evaporation passages 31 in the upstream section of the first evaporation passage group 31*a*.

Accordingly, the efficiency of heat transfer from air flowing outside the plural upstream side passage tubes 30 to the refrigerant flowing through the upstream side evaporation passages 31 in the downstream section is higher than that of heat transfer from air flowing outside the plural upstream side passage tubes 30 to the refrigerant flowing through the upstream side evaporation passages 31 in the upstream section.

Consequently, air flowing outside the upstream side evaporation passages 31 in the downstream section of the first evaporation passage group 31*a* is cooled efficiently by the liquid-phase refrigerant. Air flowing outside the upstream side evaporation passages 31 in the upstream section is not cooled efficiently.

Thus, the refrigerant flowing through the first evaporation passage group 31*a* is evaporated and gasified by heat exchange with air to be a superheated vapor (superheated gas), and flows through the upstream side upper tank portions 32 of the upper tank portion group 32*a* into the discharge passage 16*a* of the discharge pipe 16. Subsequently, the superheated vapor of the refrigerant flows through a refrigerant discharge pipe (not shown), and is sucked through the suction port into the refrigerant compressor.

An effect of the first embodiment will be described.

In this embodiment, in the refrigerant evaporator 1, of the plural downstream side evaporation passages 21 and the plural upstream side evaporation passages 31 are divided into two groups substantially at the middles thereof with respect to the width, the refrigerant flows in the same direction through the first evaporation passage group 21*a* of the downstream side heat exchanging unit 2 and the first evaporation passage group 31*a* of the upstream side heat exchanging unit 3 overlapping with the first evaporation passage group 21*a* of the downstream side heat exchanging unit 2, and flows in the same direction through the second evaporation passage group 21*b* of the downstream side heat exchanging unit 2 and the second evaporation passage group 31*b* of the upstream side heat exchanging unit 3 overlapping with the second evaporation passage group 21*b* of the downstream side heat exchanging unit 2.

Accordingly, as shown in FIG. 4, an efficient heat exchange area 2*a* in the first evaporation passage group 21*a* in which the liquid-phase refrigerant is easy to flow, and an efficient heat exchange area 3*a* in the first evaporation passage group 31*a* in which the liquid-phase refrigerant is easy to flow are symmetrical with each other. Similarly, an inefficient heat exchange area 2*c* in the first evaporation passage group 21*a* in which the liquid-phase refrigerant is hard to flow and an inefficient heat exchange area 3*c* in the first evaporation passage group 31*a* in which the liquid-phase refrigerant is hard to flow are symmetrical with each other.

As shown in FIG. 5, an efficient heat exchange area 2*b* in the second evaporation passage group 21*b* in which the liquid-phase refrigerant is easy to flow, and an efficient heat exchanging area 3*b* in the second evaporation passage group 31*b* in which the liquid-phase refrigerant is easy to flow are symmetrical with each other. Similarly, an inefficient heat exchange area 2*d* in the second evaporation passage group 21*b* in which the liquid-phase refrigerant is hard to flow and an inefficient heat exchange area 3*d* in the second evaporation passage group 31*b* in which the liquid-phase refrigerant is hard to flow are symmetrical with each other.

Thus, the respective inefficient heat exchange areas of the downstream side heat exchanging unit 2 and the upstream side heat exchanging unit 3 disposed so as to overlap with each other with respect to the airflow direction do not overlap with each other with respect to the airflow direction. Consequently, the biased temperature distribution of air cooled by heat exchange can be prevented, and air having uniform temperature distribution can be blown out from the refrigerant evaporator 1.

A second embodiment of the present invention will be described.

Figure 6:
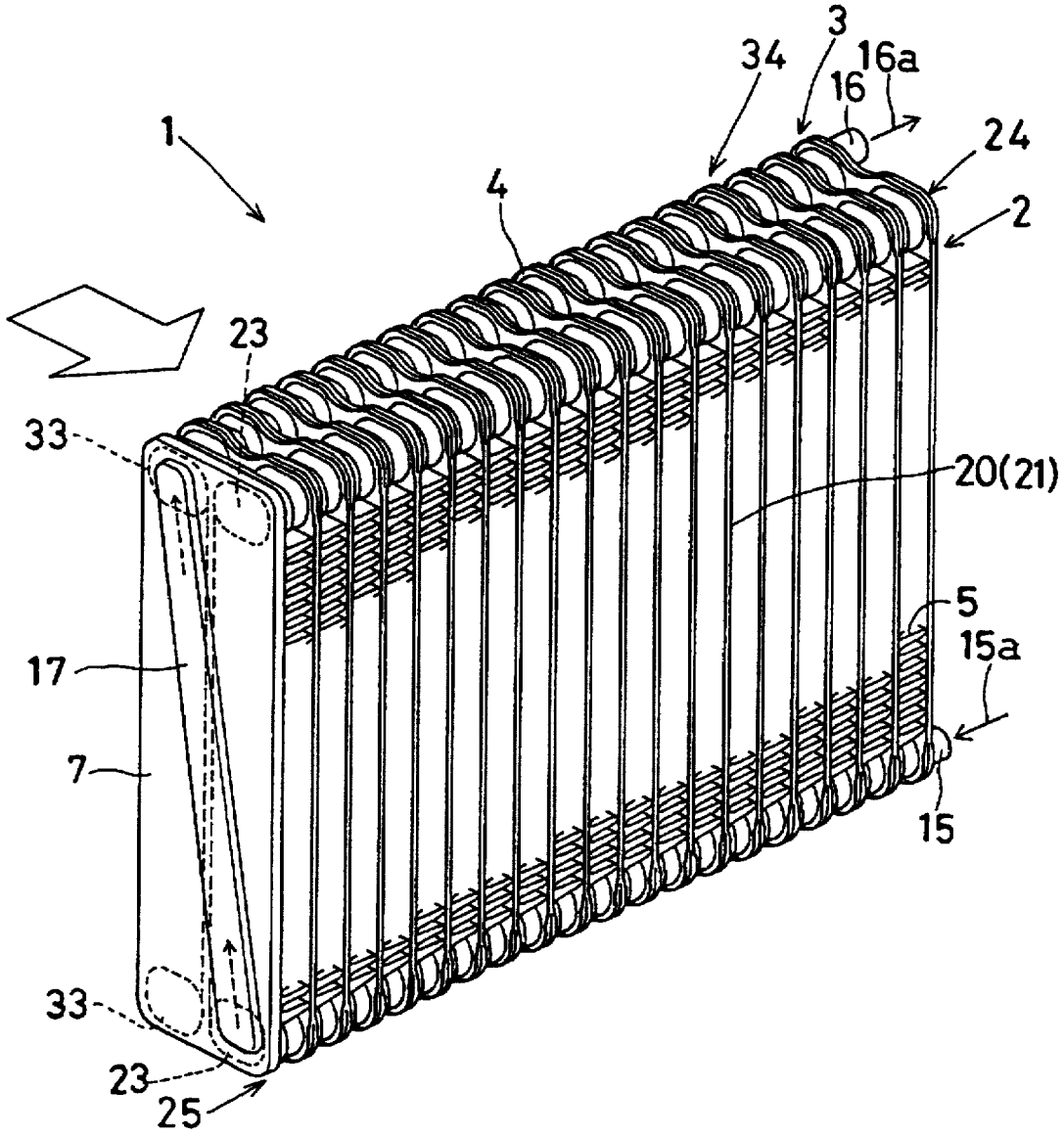
FIG. 6 is a perspective view of a left-right two-sectioned refrigerant evaporator in a second embodiment.

FIG. 6 shows a left-right two-sectioned refrigerant evaporator 1 in the second embodiment according to the present invention.

In the refrigerant evaporator 1 in this embodiment, a downstream side lower tank 25 of a downstream side heat exchanging unit 2 and an upstream side upper tank 34 of an upstream side heat exchanging unit 3 are communicated by a communication pipe 17 to introduce the refrigerant in one direction from the downstream side heat exchanging unit 2 to the upstream side heat exchanging unit 3. The connecting pipe 17 is attached to the outer surface of a flat side plate 7 to form a communication passage of a circular, a C-shaped, a U-shaped or V-shaped cross section in the communication pipe 17 or between the communication pipe 17 and the side plate 7. A hole (not shown) formed at a position in a lower end portion on the downstream side and a hole (not shown) at a position in an upper end portion on the upstream side of the side plate 7 are communicated by the communication passage.

A third embodiment of the present invention will be described.

Figure 7:
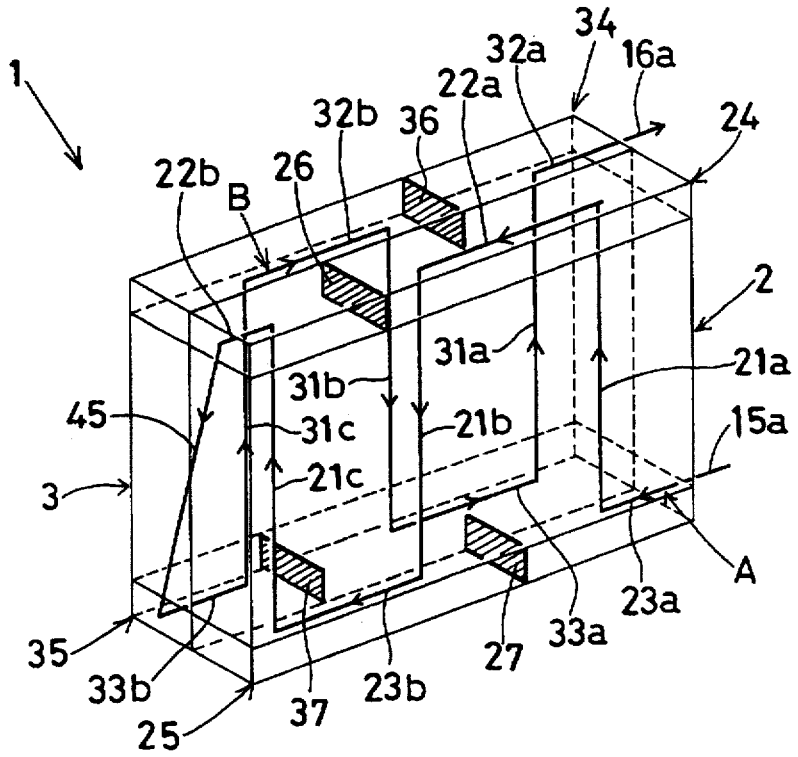
FIG. 7 is a diagrammatic view for explaining the flowing direction of a refrigerant in a three-sectioned refrigerant evaporator in a third embodiment.

FIG. 7 shows the flow of a refrigerant in a left-right three-sectioned refrigerant evaporator (hereinafter referred to simply as "refrigerant evaporator") 1 in the third embodiment according to the present invention.

In this refrigerant evaporator 1, a downstream side upper tank 24 and an upstream side lower tank 35 are communicated, and the refrigerant flows in one direction from a downstream side heat exchanging unit 2 toward an upstream side heat exchanging unit 3 through a communication passage 45.

The downstream side heat exchanging unit 2 is provided with a separator 26 for dividing plural downstream side upper tank portions 22 of the downstream side heat exchanging unit 2 into two upper tank portion groups 22*a* and 22*b*, and a separator 27 for dividing plural downstream side lower tank portions 23 into two lower tank portion groups 23*a* and 23*b*. The separators 26 and 27 divide plural downstream side evaporation passages 21 into three evaporation passage groups, i.e., a first evaporation passage group 21*a*, a second evaporation passage group 21*b* and a third evaporation passage group 21*c*.

The upstream side heat exchanging unit 3 is provided with a separator 36 for dividing plural upstream side upper tank portions 32 into tow upper tank portion groups 32*a* and 32*b*, and a separator 37 for dividing plural upstream side lower tank portions 33 into two lower tank portion groups 33*a* and 33*b*. The separators 36 and 37 divide plural upstream side evaporation passages 31 into three evaporation passage groups, i.e., a first evaporation passage group 31*a*, a second evaporation passage group 31*b* and a third evaporation passage group 31*c*.

The refrigerant flowing through an inlet passage 15*a* is introduced through a downstream side refrigerant passage A formed in the downstream side heat exchanging unit 2, i.e., through the lower tank portion group 23*a*, the first evaporation passage group 21*a*, the upper tank portion group 22*a*, the second evaporation passage group 21*b*, the lower tank portion group 23*b*, the third evaporation passage group 21*c*, the upper tank portion group 22*b*, and the communication passage 45 in this order.

The refrigerant flowing from the communication passage 45 is introduced through an upstream side refrigerant passage B, i.e., through the lower tank portion group 33*b*, the third evaporation passage group 31*c*, the first evaporation passage group 31*a* and the upper tank portion group 32*a*, and a discharge passage 16*a* in this order.

A fourth embodiment of the present invention will be described.

Figure 8:
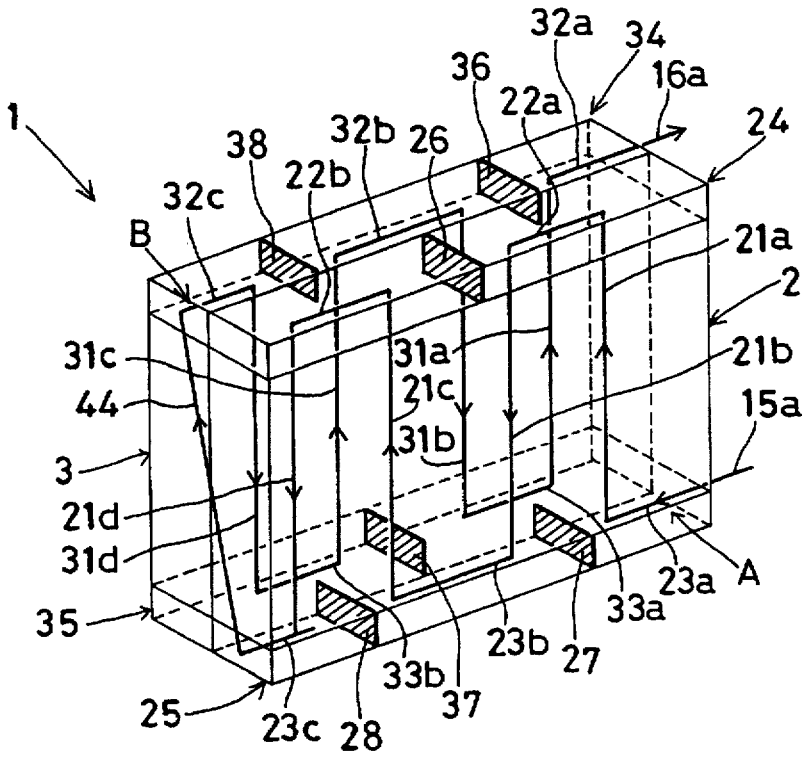
FIG. 8 is a diagrammatic view for explaining the flowing direction of a refrigerant in a four-sectioned refrigerant evaporator in a fourth embodiment.
Figure 10:
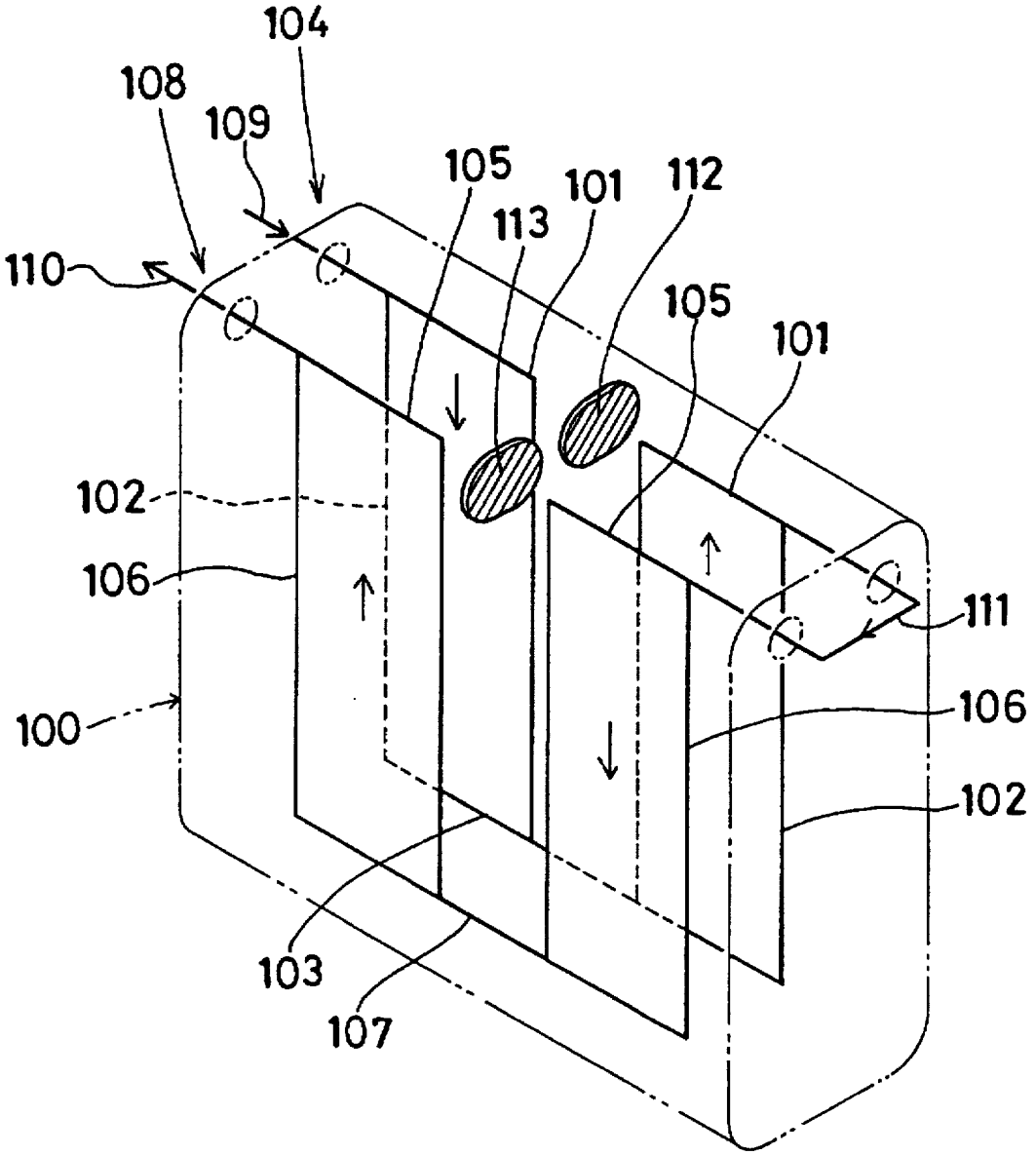
FIG. 10 PRIOR ART
FIG. 10 is a diagrammatic view for explaining the flowing direction of a refrigerant in a conventional two-sectioned refrigerant evaporator.

FIG. 8 shows the flow of a refrigerant in a right-left four-sectioned refrigerant evaporator (hereinafter referred to simply as "refrigerant evaporator") 1 in the fourth embodiment according to the present invention.

A downstream side heat exchanging unit 23 is provided with a separator 26 for dividing plural downstream side upper tank portions 22 into two upper tank portion groups 22*a* and 22*b*, and separators 27 and 28 for dividing plural downstream side lower tank portions 23 into three lower tank portion groups 23*a* to 23*c*. The separators 26 to 28 divide plural downstream side evaporation passages 21 into four evaporation passage groups, i.e., a first evaporation passage group 21*a*, a second evaporation passage group 21*b*, a third evaporation passage group 21*c* and a fourth evaporation passage group 21*d*.

An upstream side heat exchanging unit 3 is provided with separators 36 and 38 for dividing plural upstream side upper tank portions 32 into three upper tank portion groups 32*a* to 32*c*, and a separator 37 dividing plural upstream side lower tank portions 33 into two lower tank portion groups 33*a* and 33*b*. The separators 36 to 38 divide plural downstream side evaporation passages 31 into four evaporation passages, i.e., a first evaporation passage group 31*a*, a second evaporation passage group 31*b*, a third evaporation passage group 31*c* and a fourth evaporation passage group 31*d*.

The refrigerant flowing through a inlet passage 15*a* is introduced through a downstream side refrigerant passage A formed in the downstream side heat exchanging unit 2, i.e., through the lower tank portion group 23*a*, the first evaporation passage group 21*a*, the upper tank portion group 22*a*, the second evaporation passage group 21*b*, the lower tank portion group 23*b*, the third evaporation passage group 21*c* and the upper tank portion group 22*b*, the fourth evaporation passage group 21*d*, the lower tank portion group 23*c*, and a communication passage 44 in this order.

The refrigerant flowing from the communication passage 44 is introduced through an upstream side refrigerant passage B, i.e., through the upper tank portion group 32*c*, the fourth evaporation passage group 31*d*, the lower tank portion group 33*b*, the third evaporation passage group 31*c*, the upper tank portion group 32*b*, the second evaporation passage group 31*b*, the lower tank portion group 33*a*, the first evaporation passage group 31*a*, the upper tank portion group 32*a*, and a discharge passage 16*a* in this order.

A fifth embodiment of the present invention will be described.

Figure 9:
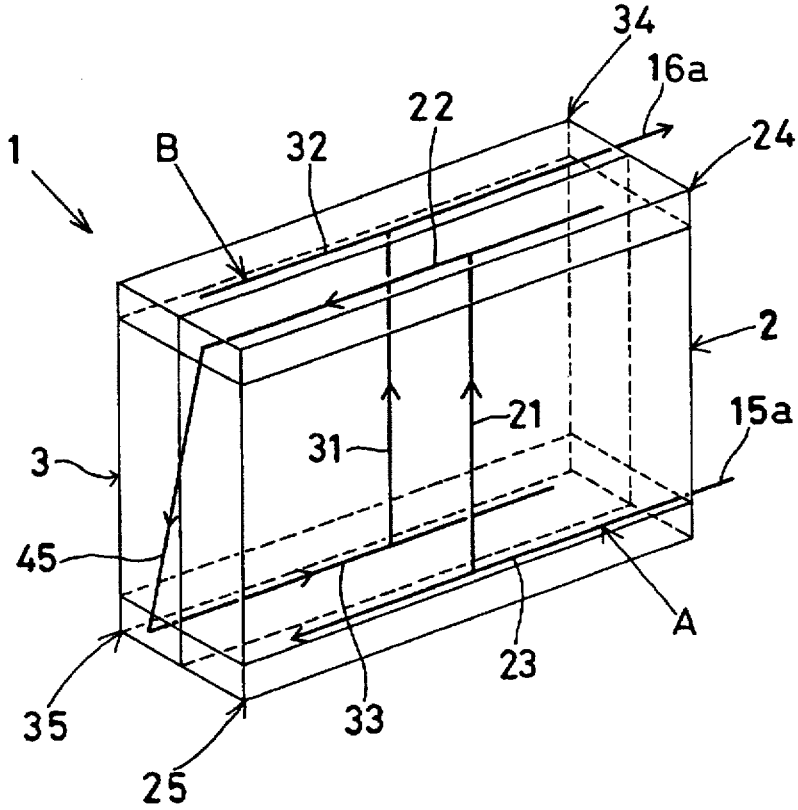
FIG. 9 is a diagrammatic view of assistance in explaining the flowing direction of a refrigerant in a one-way type refrigerant evaporator in a fifth embodiment.

FIG. 9 shows the flow of a refrigerant in a one-way type refrigerant evaporator (hereinafter referred to simply as "refrigerant evaporator") 1 in the fifth embodiment according to the present invention.

In this embodiment, the refrigerant flowing through a inlet passage 15*a* is introduced through a downstream refrigerant passage A formed in the downstream side heat exchanging unit 2, i.e., through plural downstream lower tank portion 23, plural downstream side evaporation passages 21, plural downstream side upper tank portions 22, and a communication passage 45, in this order. The refrigerant flowing from the communication passage 44 is introduced through an upstream side refrigerant passage B, i.e., through plural upstream side lower tank portions 33, the plural upstream side evaporation passages 31, plural upstream side upper tank portions 32, and a discharge passage 16*a*.

Although the present invention is applied to the refrigerant evaporator 1 constructed by laminating plural flat passage tubes formed by joining together the pair of pressed plates 4 in this embodiment, the present invention can be applied to plate-fin tube type refrigerant evaporators and multiflow type refrigerant evaporator having flat tubes internally provided with plural refrigerant passages.

In the foregoing embodiments, the refrigerant evaporator 1 is disposed with its height in a vertical direction and its width in a horizontal direction, and the plural downstream side evaporation passages 21 and the plural upstream side evaporation passages 31 are disposed so that the refrigerant flows vertically. The same effects as those of the foregoing embodiments can be obtained by a modification in which a refrigerant evaporator 1 is disposed with its height inclined to a vertical direction, and plural downstream side evaporation passages 21 and plural upstream side evaporation passages 31 are inclined to a vertical direction so that the refrigerant flows in directions inclined to a vertical direction.

Although the refrigerant inlet passage is formed in the downstream side lower tank portion 23 of the lower tank portion group 23*a*, and the refrigerant discharge passage is formed in the upstream side upper tank portion 32 of the upper tank portion group 32*a* in the foregoing embodiments, the plural downstream side upper tank portions 22 may be divided into an odd or even number of downstream side upper tank portion groups, the refrigerant inlet passage may be formed in the downstream side upper tank portion 22 of the upper tank portion group 22*a* on the most upstream side with respect to the flowing direction of the refrigerant, the plural upstream side lower tank portions 23 may be divided into an odd or even number of groups, and the refrigerant discharge passage may be formed in the upstream side lower tank portion 33 of the lower tank portion group 33*a* on the most downstream side with respect to the flowing direction of the refrigerant; that is, the refrigerant evaporator 1 in each of the foregoing embodiments may be disposed upside down.

The first evaporation passages may be divided into an even number of evaporation passage groups by separators and the second evaporation passages may be divided into an odd number of evaporation passage groups by separators. When the first and the second evaporation passages are thus divided, the refrigerant flows in the same vertical direction only in some of the first evaporation passages and some of the second evaporation passages overlapping with the first evaporation passages, and the refrigerant inlet passage and the refrigerant discharge passage are formed side by side in the first and the second upper or in the first and the second lower tank.

Figure 11:
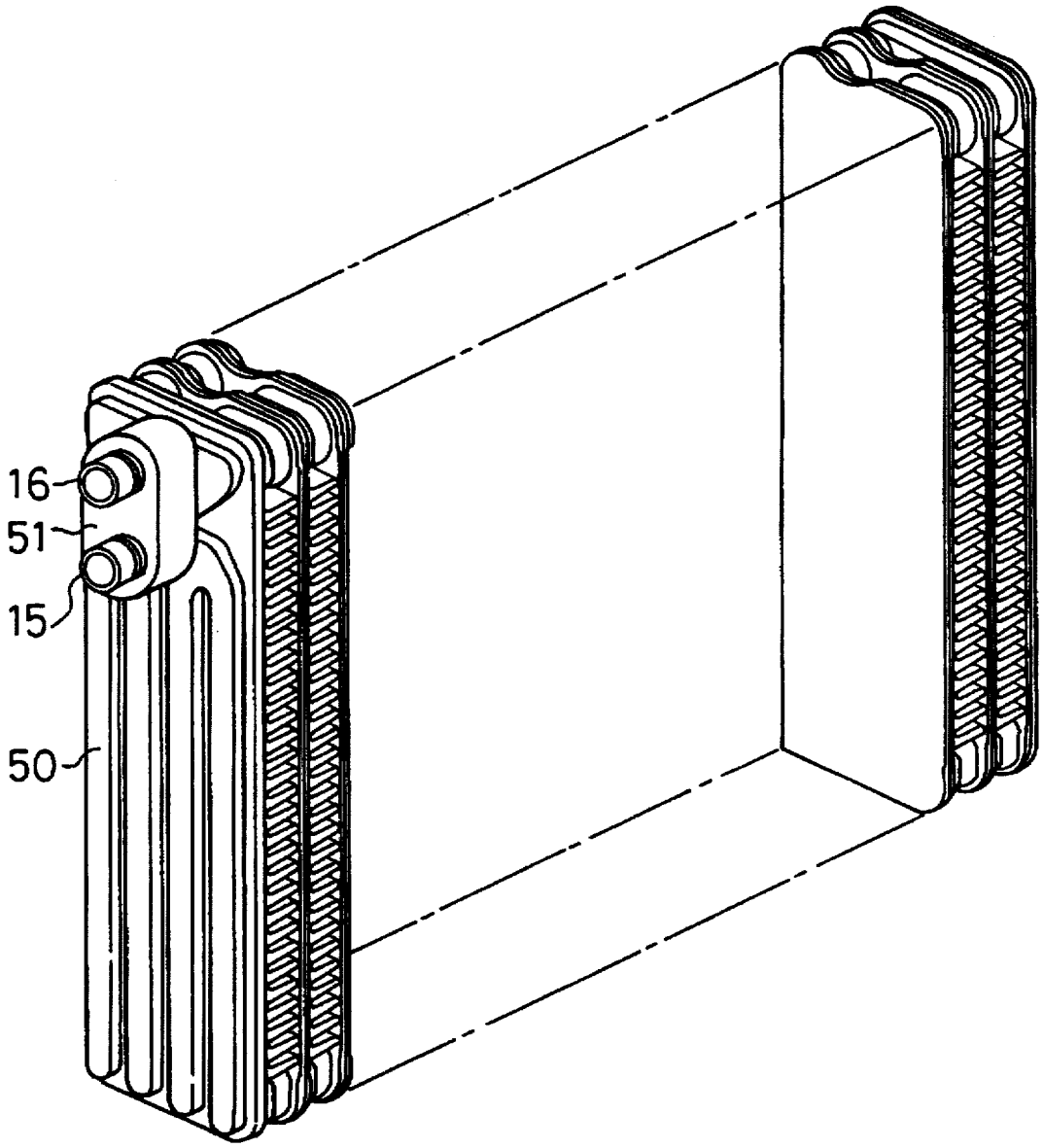
FIG. 11 is a perspective view of a modification of the refrigerant evaporator.

Although the inlet pipe 15 and the discharge pipe 16 are attached to the refrigerant evaporator while being apart from each other in the embodiments illustrated in FIGS. 1 to 9, the refrigerant evaporator may be provided with a side plate 50 to form the inlet passage and the discharge passage adjacent to each other as shown in FIG. 11, and the inlet pipe 15 and the discharge pipe 16 may be gathered on and connected to a long cylindrical joint 51 attached to an upper portion of the side plate 50.

Figure 12:
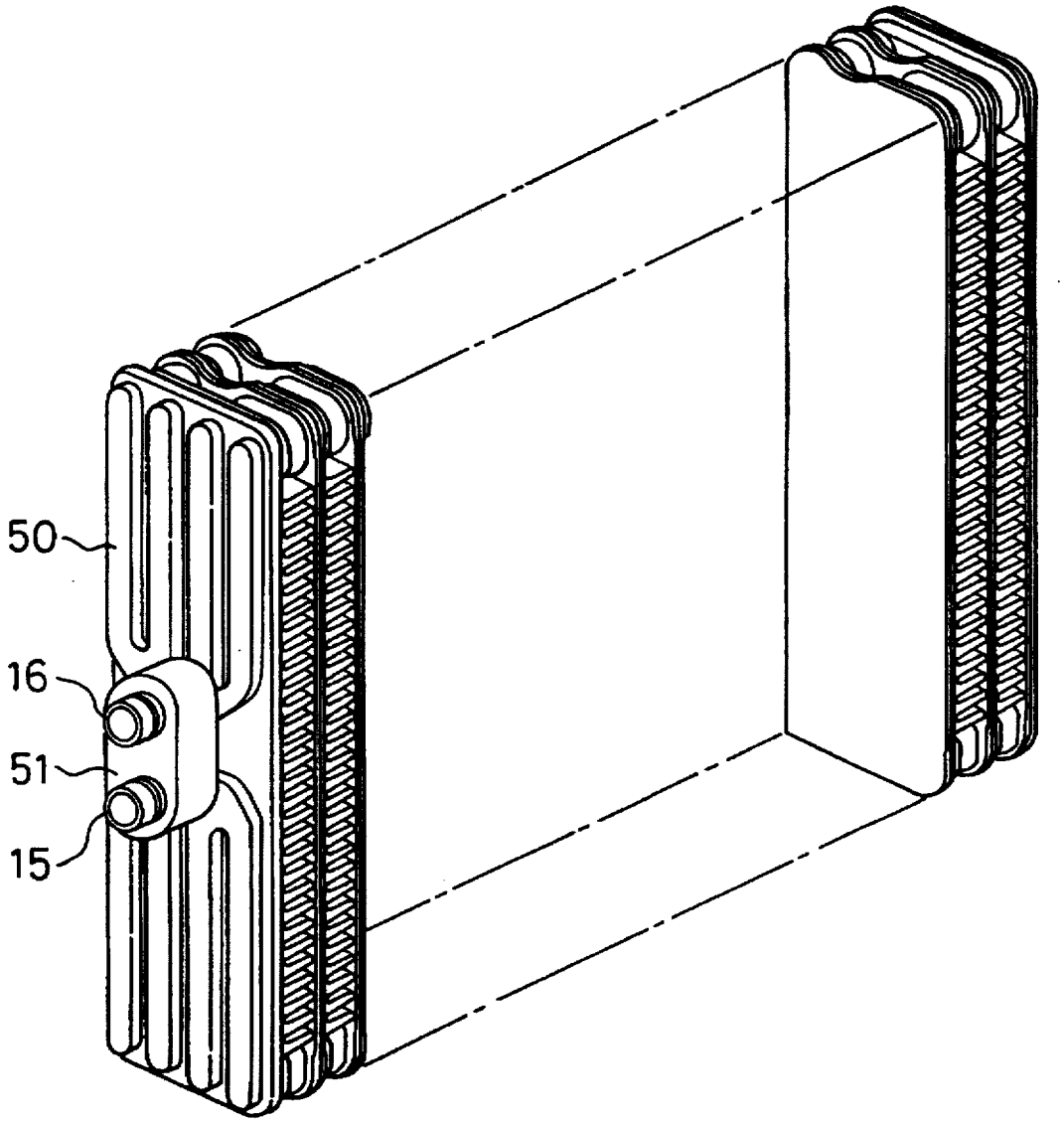
FIG. 12 is a perspective view of another modification of the refrigerant evaporator.
Figure 13:
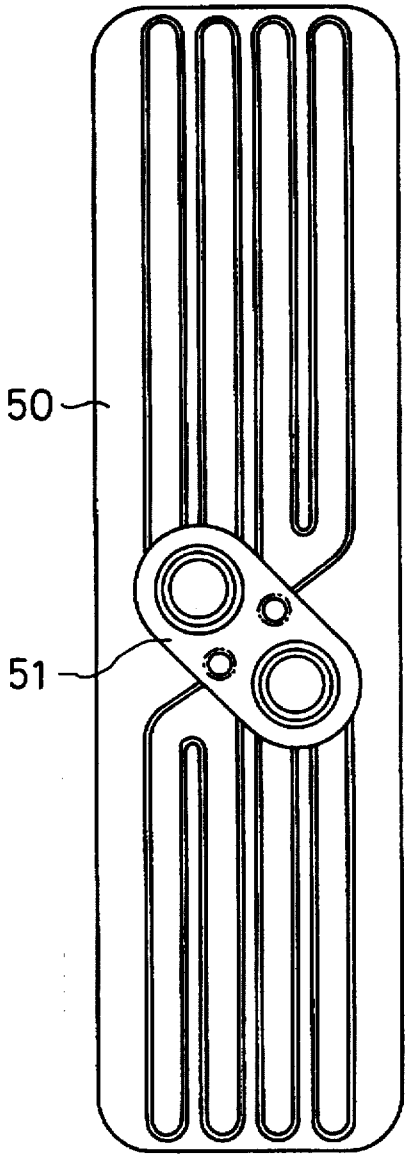
FIG. 13 is a side view of the modification.
Figure 14:
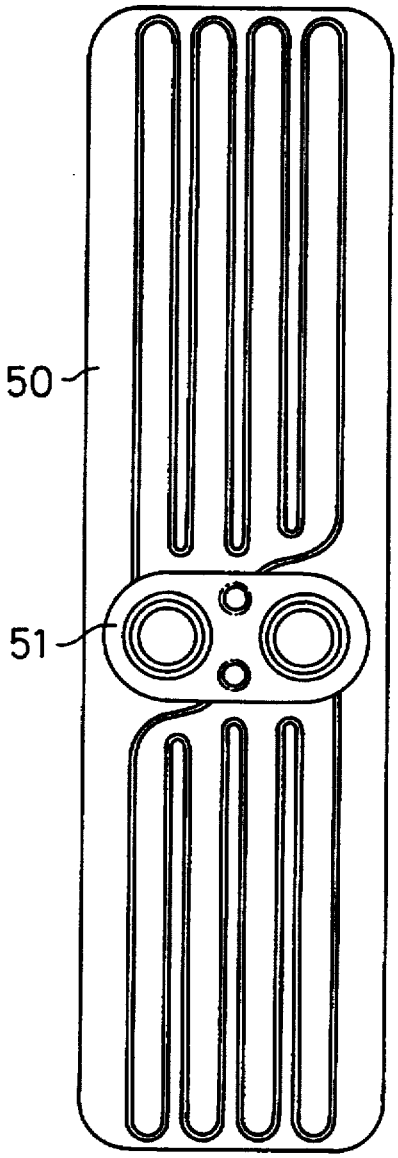
FIG. 14 is another side view of the modification.

The inlet pipe 15 and the discharge pipe 16 may be gathered on the central portion of the side plate 50 as shown in FIG. 12. In this case, long sides of the joint 51 may be attached while being inclined as shown in FIG. 13, or long sides of the joint 51 may be attached while being extended transversely as shown in FIG. 14.

Figure 15:
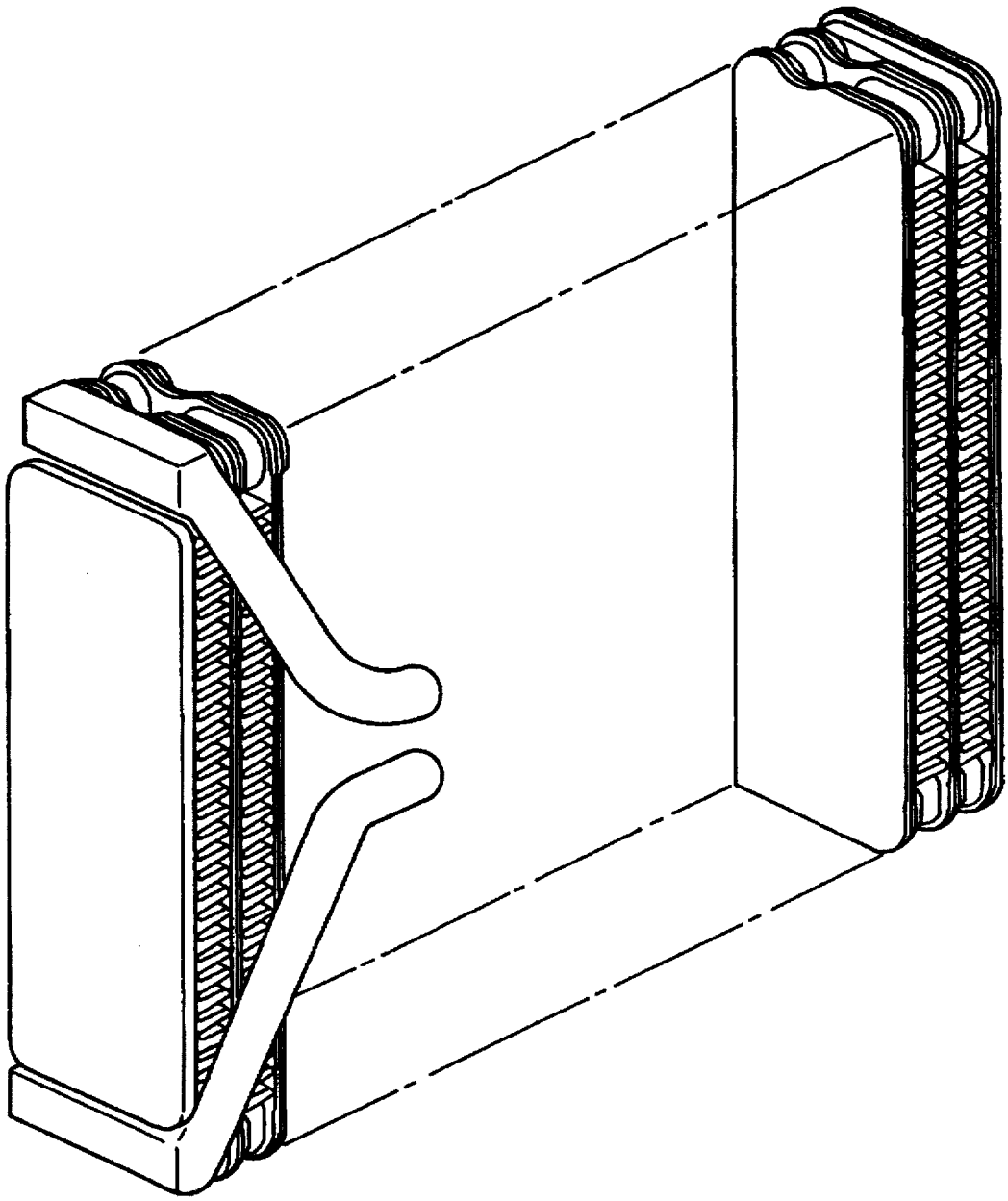
FIG. 15 is a perspective view of another modification of the refrigerant evaporator.

The inlet pipe 15 and the discharge pipe 16 may be extended so as to project on the upstream side or on the downstream side of the refrigerant evaporator as shown in FIG. 15.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A refrigerant evaporator for evaporating refrigerant flowing therein so as to cool outside air flowing therethrough, comprising:

first evaporation passage means for defining plural first evaporation passages through which the refrigerant flows, said plural first evaporation passages being formed vertically and arranged substantially in parallel with each other in a direction substantially perpendicular to the flowing direction of said outside air;

a first tank portion connected to each of upper ends and lower ends of said plural first evaporation passages, said first tank portion being extended in a direction crossing said first evaporation passages;

second evaporation passage means for defining plural second evaporation passages through which the refrigerant flows, said plural second evaporation passages being formed vertically and arranged substantially in parallel with each other in a direction substantially perpendicular to the flowing direction of said outside air, said plural second evaporation passages being disposed adjacent to said first evaporation passages at a downstream side of said first evaporation passages with respect to the flowing direction of said outside air;

a second tank portion connected to each of upper ends and lower ends of said plural second evaporation passages, and said second tank portion being extended in a direction crossing said second evaporation passages; and communication means for defining a communication passage for communicating between said plural first evaporation passages and said plural second evaporation passage;

wherein the refrigerant flows in the same vertical direction at least in portions where said plural first evaporation passages and said plural second evaporation passages overlap with each other with respect to the flowing direction of the outside air, and the flowing direction of the refrigerant in said first tank portion connected to said first evaporation passages and that in said second tank portion connected to said second evaporation passages are opposite to each other.

2. A refrigerant evaporator according to claim 1, wherein, said first tank portion includes a first upper tank connected to each of said upper ends of said first evaporation passages, and a first lower tank connected to each of said lower ends of said first evaporation passages; and said second tank portion includes a second upper tank connected to each of said upper ends of said second evaporation passages, and a second lower tank connected to each of said lower ends of said second evaporation passages.

3. A refrigerant evaporator according to claim 2, wherein, said second lower tank includes a refrigerant inlet at one end thereof, said first upper tank includes a refrigerant outlet at one end thereof, and refrigerant introduced through said refrigerant inlet into said second lower tank flows upward through all of said second evaporation passages, flows from said second upper tank through said communication passage into said first lower tank, flows upward through said first evaporation passages, and then flows outside through said refrigerant outlet.

4. A refrigerant evaporator according to claim 2, further comprising:

a first partition member for partitioning an interior of said first upper tank into plural sections; and a second partition member for partitioning an interior of said second lower tank into plural sections.

5. A refrigerant evaporator according to claim 4, wherein the number of said sections of said first upper tank partitioned by said first partition member is equal to that of said second lower tank partitioned by said second partition member.

6. A refrigerant evaporator according to claim 5, wherein each interior of said first upper tank and said second lower tank is partitioned into two sections.

7. A refrigerant evaporator according to claim 5, wherein each interior of said first upper tank and said second lower tank is divided into two sections, and each interior of said first lower tank and said second upper tank is divided into two sections.

8. A refrigerant evaporator according to claim 5, wherein each interior of said first upper tank and said second lower tank is divided into three sections, and each interior of said first lower tank and said second upper tank is divided into two sections.

9. A refrigerant evaporator according to claim 5, wherein, said second lower tank includes a refrigerant inlet at one end thereof;

said first upper tank includes a refrigerant outlet at one end thereof; and the other end of said second lower tank and the other end of said first upper tank are communicated by said communication passage.

10. A refrigerant evaporator according to claim 1, wherein, each of said plural first evaporation passages overlaps with each of said plural second evaporation passages overlap with respect to the flowing direction of the outside air, and each pair of directions of the refrigerant flowing vertically in said first evaporation passage and said second evaporation passage, which overlap with each other, are the same.

11. A refrigerant evaporator according to claim 4, wherein said first evaporation passages are divided into an even number of evaporation passage groups, and said second evaporation passages are divided into an odd number of evaporation passage groups.

* * * * *

UNITED STATES PATENT AND TRADEMARK OFFICE

CERTIFICATE OF CORRECTION

PATENT NO. : 5,701,760

DATED : December 30, 1997

INVENTOR(S) : Eiichi Torigoe et al

It is certified that error appears in the above-identified patent and that said Letters Patent is hereby corrected as shown below:

Col. 2, line 28, after "flow" insert --of--

Col. 3, line 3, "other," should be --other.--

Col. 3, line 8, "passed" should be --passing--

Col. 11, line 1, "tow" should be --two--

Col. 11, line 52, "a" should be --an--

Col. 12, line 10, "a" should be --an--

Col. 15, line 8, claim 10, delete "evapo"

Col. 16, line 1, claim 10, delete "ration" and substitute --evaporation-- therefor Signed and Sealed this Third Day of November, 1998

*Attest:*

Bruce Lehman

BRUCE LEHMAN

*Attesting Officer*

*Commissioner of Patents and Trademarks*